US009295892B2

(12) United States Patent
Harrigan

(10) Patent No.: US 9,295,892 B2
(45) Date of Patent: Mar. 29, 2016

(54) MARTIAL ARTS SENSITIVITY AND SPEED TRAINING DEVICE AND METHOD

(71) Applicant: Daniel Connolly Harrigan, Casselberry, FL (US)

(72) Inventor: Daniel Connolly Harrigan, Casselberry, FL (US)

( * ) Notice: Subject to any disclaimer, the term of this patent is extended or adjusted under 35 U.S.C. 154(b) by 0 days.

(21) Appl. No.: 14/535,488

(22) Filed: Nov. 7, 2014

(65) Prior Publication Data

US 2015/0065312 A1 Mar. 5, 2015

Related U.S. Application Data

(63) Continuation-in-part of application No. 13/654,396, filed on Oct. 17, 2012, now abandoned.

(60) Provisional application No. 61/654,653, filed on Jun. 1, 2012.

(51) Int. Cl.

| | |
|---|---|
| ***A63B 69/32*** | (2006.01) |
| ***A63B 69/00*** | (2006.01) |
| ***A63B 69/34*** | (2006.01) |
| ***A63B 71/06*** | (2006.01) |

(52) U.S. Cl.

CPC ..... *A63B 69/004* (2013.01); *A63B 69/32* (2013.01); *A63B 69/34* (2013.01); *A63B 71/0622* (2013.01); *A63B 2071/0625* (2013.01); *A63B 2220/53* (2013.01); *A63B 2220/801* (2013.01); *A63B 2220/833* (2013.01)

(58) Field of Classification Search

CPC ..... A63B 69/004; A63B 69/32; A63B 69/34; A63B 69/325; A63B 71/0622; A63B 2220/801; A63B 2220/53; A63B 2220/833; A63B 69/20; A63B 69/201; A63B 69/203; A63B 69/205; A63B 69/206; A63B 69/208; A63B 69/24; A63B 69/345; A63B 71/0619; A63B 71/0625; A63B 71/2071; A63B 2071/0694

USPC ..... 482/83, 84

See application file for complete search history.

(56) References Cited

U.S. PATENT DOCUMENTS

| | | | | |
|---|---|---|---|---|
| 6,808,477 | B2 * | 10/2004 | Tudor | 482/83 |
| 7,416,517 | B2 * | 8/2008 | Mitchell | 482/90 |
| 7,794,370 | B2 * | 9/2010 | Tackett | 482/83 |
| 8,602,944 | B2 * | 12/2013 | Fleitz | 482/8 |
| 2008/0254950 | A1 * | 10/2008 | Beliles | 482/83 |
| 2014/0066266 | A1 * | 3/2014 | Chang | 482/83 |
| 2014/0274588 | A1 * | 9/2014 | Nelson | 482/90 |

* cited by examiner

*Primary Examiner* — Loan H Tranh
*Assistant Examiner* — Megan Anderson

(57) ABSTRACT

A martial arts sensitivity and speed training device and method is provided. The training device may be a midi tongue drum wing chun dummy adapted to play sounds when the dummy is impacted by a practitioner. The dummy enables practitioners to practice dangerous techniques without the aid of human person and also increase their familiarity, sensitivity, speed and accuracy with striking acupuncture and related pressure points on the body of a human person.

11 Claims, 3 Drawing Sheets

MARTIAL ARTS SENSITIVITY AND SPEED TRAINING DEVICE AND METHOD

CROSS-REFERENCE TO RELATED APPLICATION

This application is a continuation-in-part application of U.S. non-provisional application Ser. No. 13/654,396, filed Oct. 17, 2012, and claiming the benefit priority of U.S. provisional application No. 61/654,653, filed Jun. 1, 2012, the contents of which are herein incorporated by reference.

BACKGROUND OF THE INVENTION

The present invention relates to relates to a martial arts sensitivity and speed training device acting as an acoustic and electronic musical drum trigger instrument.

A wing chun practitioner typically uses a wooden dummy for practice. The use of the dummy aims to refine a practitioner's understanding of angles, positions, and footwork, and to develop full body power. The practitioner is able to use the dummy to practice open hand forms of wing chun and piece together various wing chun techniques which can then be understood as a whole. However, current devices are heavy and relatively non-portable, because they are generally comprise solid posts of wood and/or boxing heavy bags.

Sensors on wing chun dummys and other training apparatuses that convert impact forces thereon into electric signals to control associated electronics, such as, for example sound and/or light modules is known in the art. Specifically, U.S. Pat Appn. 2011/0015040—Z. Fleitz and U.S. Pat. No. 7,794,370—J. Tackett.

The problem of providing only a few striking regions representing gross anatomical targets of the Tackett instrument and of the Fleiss instrument are surpassed by the present invention. Although striking gross anatomical targets like the head and solar plexus and groin can have an effect of slowing down an assailant much of the time, it must be stressed that the longer two people are fighting the greater chance for both parties to be injured. Fights need to be ended quickly for this reason. There needs to be more than a few regions of attack for one to quickly end an assailant's attempts to injure. Tackett's device, which provides generalized strategic punching or kicking locations, incorporates such limitations. Similarly, Fleitz's instrument involves exclusively striking the appendages on the Wing Chun dummy. A fight cannot be won, and effective self-defense cannot be accomplished, just by blocking, parrying and striking appendages. Even in Western boxing with rules this is considered true. Body and head shots need to occur. Arm and leg attacks tend to be the preparation/setups for the ending blows.

As can be seen, there is a need for an improved martial arts sensitivity and speed training method that utilizes a light weight device, wherein such device provides more than generalized striking targets or targets limited to the striking of appendages or the generalized strategic punching or kicking locations of a would be attacker.

SUMMARY OF THE INVENTION

In one aspect of the present invention, a martial arts sensitivity and speed training device comprises: a wing chun dummy having a hollow main body; a midi tongue drum controller disposed within the hollow main body; and a plurality of midi pickup/drum trigger/tongues disposed on an outer surface of the main body, wherein each midi pickup/drum trigger/tongue is electronically connected to the midi tongue drum controller, and wherein the midi tongue drum controller is configured to plays a predetermined sound for each midi pickup/drum trigger/tongue a practitioner physically impacts.

In another aspect of the present invention, a method of training martial arts sensitivity and speed, comprises providing training device comprising: a wing chun dummy having a hollow main body; a midi tongue drum controller disposed within the hollow main body; at least one ear hole, wherein each ear hole communicates with the hollow main body to form an acoustic chamber hole; a plurality of midi pickup/drum trigger/tongues disposed on an outer surface of the main body, wherein each midi pickup/drum trigger/tongue is electronically connected to the midi tongue drum controller, and wherein the midi tongue drum controller is configured to plays a predetermined sound for each midi pickup/drum trigger/tongue a practitioner physically impacts; and a plurality of striking surfaces disposed along the outer surface so as to approximate a plurality of human anatomy acupuncture points, wherein each striking surface is electrically connected to an associated midi pickup/drum trigger/tongue; configuring each striking surface to physically impact its associated midi pickup/drum trigger/tongue based in part on a portion of the strike surface the practitioner strikes; and training a practitioner according to a plurality of qi attacks on the plurality of striking surfaces.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a martial arts sensitivity and speed training device and method is provided. The training device may be a midi tongue drum wing chun dummy adapted to play sounds when the dummy is impacted by a practitioner. The dummy enables practitioners to practice dangerous techniques without the aid of human person and also increase their familiarity, sensitivity, speed and accuracy with striking acupuncture and related pressure points on the body of a human person.

Figure 1:
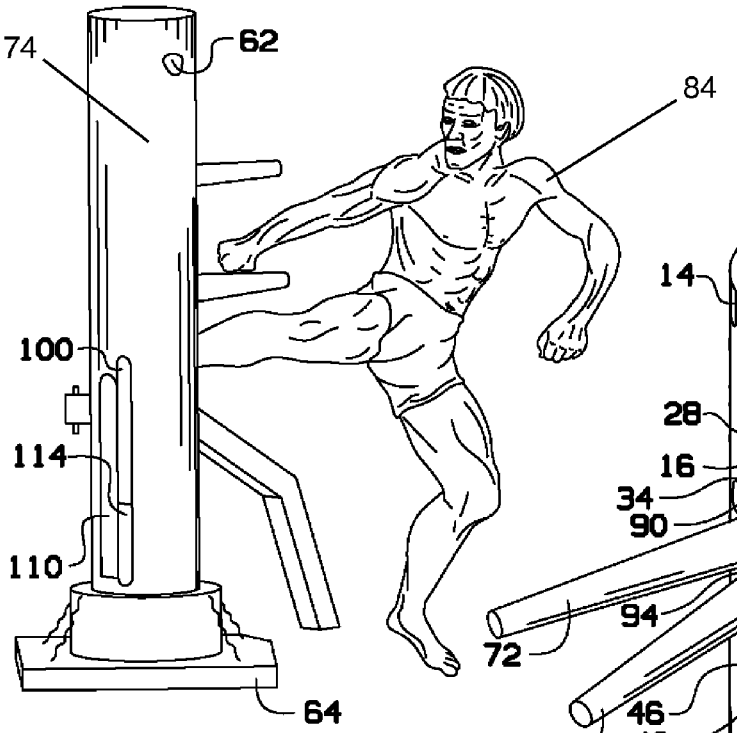
FIG. 1 is a perspective view of an exemplary embodiment of a wing chun dummy of the current invention in use.

Referring to FIG. 1, a wing chun dummy main body 74 extending from a pentagonal base 64 in a generally vertical orientation for a practitioner 84 to train. The wing chun dummy may provide a plurality of musical instrument digital interface (midi) pickup/drum trigger/tongues disposed thereon. Each midi pickup/drum trigger/tongue may be electrically connected to an associated striking surface disposed on an outer surface of the wing chun dummy. Such striking surfaces and/or midi pickup/drum trigger/tongue may include, but not be limited to, a right side "door of the capital" pickup/drum trigger/tongue 100; a right side "wind market" pickup/drum trigger/tongue 110; and a right side "basket's door" 114. The wing chun dummy main body 74 may be hollow to facilitate its transportation, its use as a training device, and/or its acoustic instrumentality. For example, the wing chun dummy of the present invention may be made of wood so that its hollow main body 74 provides unique timbres and tones independent and/or in concert with at least one midi pickup/drum trigger/tongue. For instance, the wing chun dummy may provide a pair of ear holes 62 to facilitate acoustic chamber holes in communication with its hollow main body 74. Moreover, the hollow wing chun dummy would allow a user to easily transport the wing chun dummy without need for ceiling joists or specially designed suspension racks. In another example, the wing chun dummy may be adapted to engage a slipper surface, such as grass, so that the wing chun dummy slides thereon as a practitioner 84 strikes the wing chun dummy in order to replicate combat realism so as to develop the practitioner's 84 foot work and distancing skills necessary in combat. Alternatively, the pentagonal base 64 may be anchored to a supporting grade to provide a more power-oriented training exercise.

Figure 2:
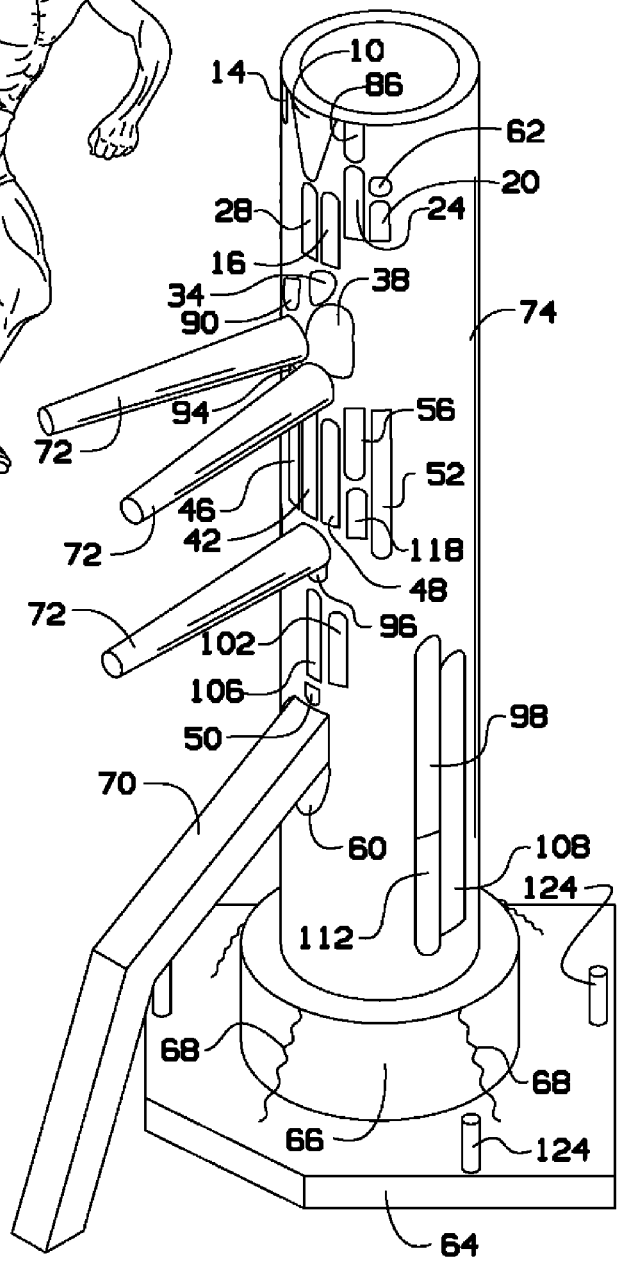
FIGS. 2 and 3 are perspective views of an exemplary embodiment of a wing chun dummy.
Figure 3:
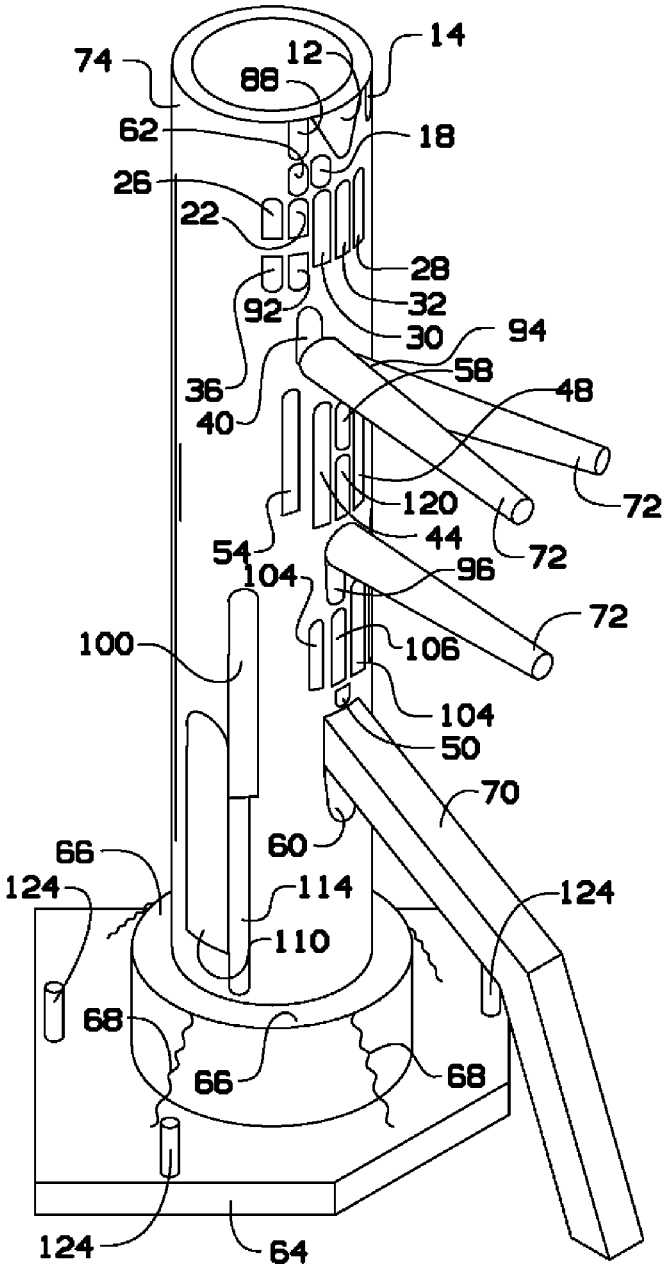

Referring to FIG. 2 and FIG. 3, an exemplary embodiment of the wing chun dummy includes a left "gallbladder triangle" pickup/drum trigger/tongue 10; a right "gallbladder triangle" pickup/drum trigger/tongue 12; a "Yin Tang", pickup/drum trigger/tongue 14; a left "eye" pickup/drum trigger/tongue 16; a right "eye, pickup/drum trigger/tongue 18; a left side "windscreen" pickup/drum trigger/tongue 20; a right side "windscreen" pickup/drum trigger/tongue 22; a left side "jaw bone" pickup/drum trigger/tongue 24; a right side "jaw bone", pickup/drum trigger/tongue 26; a left side "mental nerve lateral" pickup/drum trigger/tongue 28; a right side "mental nerve lateral" pickup/drum trigger/tongue 30; a "center mental nerve", pickup/drum trigger/tongue 32; a left side "support the prominence" pickup/drum trigger/tongue 34; a right side "support the prominence" pickup/drum trigger/tongue 36; a left side "window of heaven" pickup/drum trigger/tongue 38; a right side "window of heaven", pickup/drum trigger/tongue 40; a left side "summit's spring" pickup/drum trigger/tongue 42; a right side "summit's spring" pickup/drum trigger/tongue 44; a left side "spirit's seal" pickup/drum trigger/tongue 46; a right side "spirit's seal" pickup/drum trigger tongue 48; a "middle pole" pickup/drum trigger/tongue 50; a left side "big wrapping" pickup/drum trigger/tongue 52; a right side "big wrapping" pickup/drum trigger/tongue 54; a left side "expectations door" pickup/drum trigger/tongue 56; a right side "expectations door" pickup/drum trigger/tongue 58; a "groin" pickup/drum trigger/tongue 60; an "ear hole" acoustic overall instrument acoustic microphone/pickup with pickup wires exiting 62; a pentagonal base 64; an outer shallow cylinder support casing with circular springs 66; helical springs 68; a center limb extension/ "leg" 70; a conical limb extension/"arms"72; optional LED lights 76; a drum module 78; an amplifier 80; a speaker 82; a left side "bone of the eye" pickup/drum trigger/tongue 86; a right side "bone of the eye" pickup/drum trigger/tongue 88; a left side "stomach's welcome" pickup/drum trigger/tongue 90; a right side "stomach's welcome" pickup/drum trigger/tongue 92; a "chest center" pickup/drum trigger/tongue 94; a "middle cavity" pickup/drum trigger/tongue 96; a left side "door of the capital" pickup/drum trigger/tongue 98; a right side "door of the capital" pickup/drum trigger/tongue 100; a left side "heaven's pivot" pickup/drum trigger/tongue 102; a right side "heaven's pivot" pickup/drum trigger/tongue 104; the "spirit gateway" pickup/drum trigger/tongue 106; a left side "wind market" pickup/drum trigger/tongue 108; a right side "wind market" pickup/drum trigger/tongue 110; a left side "basket's door" pickup/drum trigger/tongue 112; a right side "basket's door" pickup/drum trigger/tongue 114; a left side "sun moon" pickup/drum trigger/tongue 118; and a right side "sun moon" pickup/drum trigger/tongue 120. In certain embodiments, the pentagonal base 64 may provide a plurality of weight posts 124 for weight plates 122.

Figure 4:
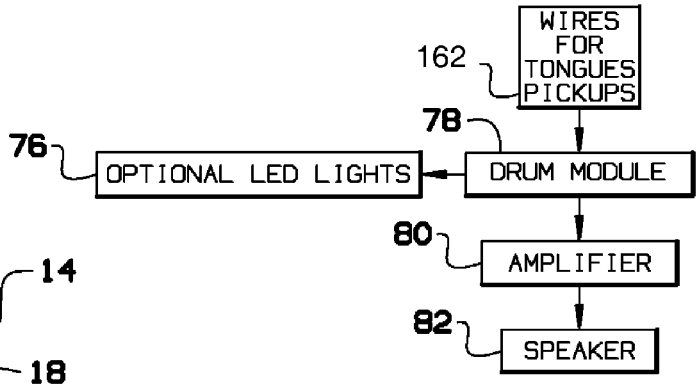
FIG. 4 is a flowchart of an exemplary embodiment of the invention.

Referring to FIG. 4, the flowchart illustrates that the wires for tongue pickups 162 are connected to a drum module 78, which is in turn connected to optional LED lights 76. The drum module 78 is also connected to an amplifier 80 and a speaker 82.

Figure 5:
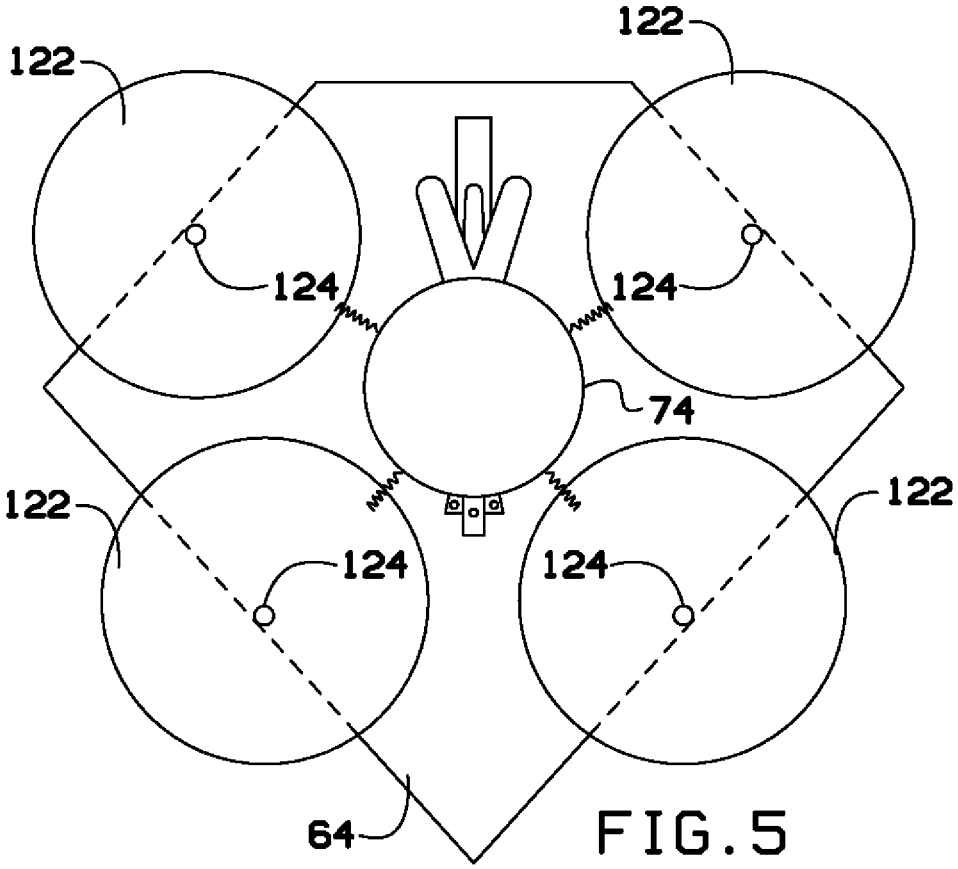
FIG. 5 is a top view of an exemplary embodiment of the invention.

Referring to FIG. 5, a top view of the wing chun dummy illustrates the weight plates 122 on the plurality of weight post 124. Such weight plates 124 facilitate anchoring the pentagonal base 64 to the supporting grade to provide a more power-oriented training exercise.

A method of using the present invention may include the following. The wing chun dummy disclosed above may be provided. A user of the present invention may accomplish unique timbres and tones by striking in a predetermined location and in a predetermined manner due to the hollow body of the wing chun dummy and a predetermined disposition of each of the plurality of midi pickup/drum trigger/tongues and their electrically connected associated striking surfaces.

Specifically, the predetermined manner of striking each striking surface may include the angles of each strike, a portion of the striking surface being stuck, the beating surfaces of the practitioner's 84 body (martial arts striking surfaces) employed in the strike, and the cupped hand slapping of the acoustic ear holes 62. Moreover, the martial arts sensitivity and speed training device of the present invention may be adapted wherein each of the plurality of striking surfaces are configured to physically impact the associated one of the plurality of tongues based in part on a beating surface the practitioner 84 strikes the striking surface. The present invention, and the method thereof, may be further adapted so that the at least one ear hole 62 is configured to produce a crisp acoustic popping sound when optimally struck with a cupped hand.

Moreover, the hollow body and the plurality of midi pickup/drum trigger/tongues facilitate musical expression, whereby a user may mix both the inherent acoustical sounds and electronic sounds, respectively. A synergy and mix of the two could be effected to create a plethora of unique and customizable musical sounds.

Moreover, the plurality of midi pickup/drum trigger/tongues are disposed about the wing chun dummy to approximate human anatomy acupuncture points. Based on Traditional Chinese Medicine theories involving vital force or "qi", such as the science of Tuite or Dim-Mak, the manipulation of acupuncture points via strikes and other techniques—sometimes these are done in combination or serially—can quickly end a fight from an assailant. There are points used on an assailant's appendages to set up head, neck and torso strikes but it is extremely rare for someone to end a fight with exclusive use of arm and leg striking attacks. Defenses of an assailant need to be breeched so other targets can be accessed. For example, the present invention has a midi pickup/drum trigger/tongue representing the gross anatomical target for the groin area 60 and for the eyes 86. The ears are also represented with acoustic chamber holes 62. Each midi pickup/drum trigger/tongue may represent acupuncture points each to be attacked in various manners, angles and which certain weapons of the human body. The present invention has at least 49 "proper" striking surfaces electrically connected to the plurality of midi pickup/drum trigger/tongues, wherein each striking surface may provide various harmonics-inducing targets (musically constituting grace notes when played) disposed about the body surfaces of the wing chun dummy. The loudest, clearest and most crisp sound with the most sustain would be at the portion of the striking surface of each midi pickup/drum trigger tongue that represents an anatomical target or acupuncture point affecting energy flow. This would teach the user of the present invention to be precise and meticulous in striking certain areas and having immediate feedback (regarding self-defense prowess) via the sound made whether he/her was optimally stuck the target. For example, the ear hole 62 attacks would make a crisp acoustic popping sound when optimally struck.

During Dim-Mak attacks "qi-attackes" to the various acupuncture points, the vital force "qi" can be adversely affected by draining it, by sending it backwards, by overloading the pathway, and by causing immediate and drastic disharmonies between various forms of vital force. There are also usually parallel processes that can occur with the blood vessels, nerves and organs in areas energized by the vital force in the acupuncture point areas. The eye tongue point attacks obviously render an assailant unable to sufficiently see his/her prey and continue to batter. Ear attacks can hurt balance and result in inability to chase potential prey. Other attacks can overwhelm the nerves and disallow an assailant's body to hold up his/her own weight (and thus become immobile) and continue fighting in any "stand-up"/striking versus on the ground grappling manner. Other attacks can lead to pain, incontinence, decreased ability to breathe, and most famously unconsciousness aka a knock-out.

A plurality of qi attacks of the striking surface and connected midi pickup/drum trigger/tongues (and their associated reference character), the effective angle/s of attack, weapons of attack and probable effects on assailants are as follows:

10 Left and 12 Right Gallbladder Triangle slightly downward or back using slightly cupped hand and striking all 3 points of triangle simultaneously with palm heel and knuckle mounts. Results in disorientation and unconsciousness;

14 using palm or knuckles straight in strike. Even softly results can cause disorientation, visual problems and possible knockout;

16 Left and 18 Right using tips of fingers, toes or open palm striking perpendicular or raking from the sides inward (from inside out) or outward (from outside in) Resulting in severe pain, unconsciousness or excessive tearing and thus inability to see and continue assault or battery;

20 Left and 22 Right strike from back to front usually with "shuto" strike aka karate chop using knife edge metacarpals. Results in knockout;

24 Left and right 26 angle in toward center of device using fist knuckles, hammer fist, backfist knuckles, hook kick or hooking heel kick, or gravity punch, elbow strikes, knee strikes. Results in unconsciousness;

28 Left R 30 and Center 32 straight perpendicular and toward rear centerline. Results in considerably weakening body, fighting ability and disorientation;

34 Left and 36 Right can be struck towards center of instrument with ridge hand or karate chop, cross elbows, especially if serially and bilaterally results in knock out;

38 Left and 40 Right Angle in straight in perpendicular via heel, elbow, fist, knuckles, finger tips, knees. Results in highly disrupted breathing of assailant;

42 Left and 44 Right Straight in with finger tips or toes. Results in severe disrupt heart functioning/circulation, breathing and knock out;

46 Left and 48 Right straight in perpendicular strike with fist or heel kick. Results in heart disruption, thoracic malfunctioning;

50 Downward with finger tips both hands together in prayer hands, also straight in with heel kick, side elbow, fist, back elbow, also upward. Can all result in weakening of body, incontinence of urine, knockout;

52 Left and 54 Right from the side in towards center of instrument with palms, fists, knees, heel kicks, elbows can result in disruption of liver functioning, Spleen and Liver damage and knockout;

56 Left and 58 Right strike from left to right or right to left (lateral to medial or medial to lateral) fists, kicks, elbows and knees. Can result in severe vision problems, heart and lung malfunctions and knockout;

60 upward and/or inward using instep, palm, toes, uppercutting fist, upward palm. Results in debilitating pain in seconds, inability to move and pursue a potential victim;

62 earhole chambers Left and Right using cupped hand slap perpendicular straight in. Resulting in hearing loss, immediate ringing in ears, pain and potential loss of balance;

86 Left and 88 Right from back to front with knuckles. Results in nausea, memory loss and knockout;

90 Left and 92 Right strike straight in. Use fists or metacarpal strikes—shuto or "ridge hand." Knockout due to immediate drop in blood pressure;

Downward strikes with fist, ax kicking heel, hammer fist, downward elbow can damage diaphragm and adversely affect breathing can collapse legs. Upward strikes with elbows, fists, knees, palm strikes lower body spasms and collapse of legs;

96 Slightly upward strike with fist, toes, heel kicks, upward elbow or knee strikes, Results in nausea/vomiting and damage to Spleen, pancreas, energetic imbalances (severe) and acute loss of abdominal strength;

98 Left and 100 Right Strike from the side in towards rear centerline of instrument (lateral to medial strikes). Elbows and palms strikes (front and back of palms). Can cause Kidney pain, damage and malfunction;

102 L and 104 Right struck individually or simultaneously 45 degrees downward with fists. Resulting in knockout, and acute incontinence of feces;

106 Straight inward towards read centerline. Use fingertips, fist, knees, back elbow. Resulting in multiple organ damage potential: Kidney, Spleen, Stomach as well as nausea and vomiting;

108 Left and 110 Right. Straight in Ridge hand strikes, instep or shin kicks. Resulting in inability to move leg and continue to fight, sometimes inability to hold weight on that leg;

112 Left and 114 Right Straight in with knee, toe kick, elbow or knife edge kick, weakens leg and knee joint;

118 Left and 120 Right straight in with knuckles, palm strike, elbows, knees. Results in loss of balance and knockout.

It should be understood, of course, that the foregoing relates to exemplary embodiments of the invention and that modifications may be made without departing from the spirit and scope of the invention as set forth in the following claims.

What is claimed is:

1. A martial arts sensitivity and speed training device comprising:

a wing chun dummy having a hollow main body;

a midi tongue drum controller disposed within the hollow main body; and a plurality of tongues disposed on an outer surface of the main body;

a midi pickup operative combined to each tongue of the plurality of tongues, wherein each of the plurality of tongues are electronically connected to the midi tongue drum controller, wherein the wing chun dummy further provides at least one ear hole, wherein the at least one ear hole communicates with the hollow main body to form at least one acoustic chamber hole, and wherein the midi tongue drum controller is configured to plays a predetermined sound for each of the plurality of tongues a practitioner physically impacts.

2. The martial arts sensitivity and speed training device of claim 1, wherein the wing chun dummy further provides a plurality of striking surfaces disposed along an outer surface, wherein each of the plurality of striking surfaces is electrically connected to an associated one of the plurality of tongues.

3. The martial arts sensitivity and speed training device of claim 2, wherein each of the plurality of striking surfaces are disposed so as to approximate a plurality of human anatomy acupuncture points.

4. The martial arts sensitivity and speed training device of claim 3, wherein each of the plurality of striking surfaces configured to physically impact the associated one of the plurality of tongues based in part on a portion of the strike surface the practitioner strikes.

5. The martial arts sensitivity and speed training device of claim 3, wherein each of the plurality of striking surfaces are configured to physically impact the associated one of the plurality of tongues based in part on an angle the practitioner strikes the strike surface.

6. The martial arts sensitivity and speed training device of claim 3, wherein each of the plurality of striking surfaces are configured to physically impact the associated one of the plurality of tongues based in part on a beating surface the practitioner strikes the striking surface.

7. The martial arts sensitivity and speed training device of claim 1, wherein the wing chun dummy further provides at least one appendage.

8. A method of training martial arts sensitivity and speed, comprising:

providing a training device comprising: a wing chun dummy having a hollow main body; a midi tongue drum controller disposed within the hollow main body; at least one ear hole, wherein the at least one ear hole communicates with the hollow main body to form at least one acoustic chamber hole; a plurality of tongues disposed on an outer surface of the main body; a midi pickup operative combined to each tongue of the plurality of tongues, wherein each of the plurality of tongues are electronically connected to the midi tongue drum controller, and wherein the midi tongue drum controller is configured to plays a predetermined sound for each of the plurality of tongues a practitioner physically impacts; and a plurality of striking surfaces disposed along the outer surface so as to approximate a plurality of human anatomy acupuncture points, wherein each of the plurality of striking surfaces are electrically connected to an associated tongue;

configuring each of the plurality of striking surfaces to physically impact the associated tongue based in part on a portion of the strike surface the practitioner strikes; and training the practitioner according to a plurality of qi attacks on the plurality of striking surfaces.

9. The method of claim 8, further configuring each of the plurality of striking surfaces to physically impact its associated midi pickup/drum trigger/tongue based in part on an angle the practitioner strikes the strike surface.

10. The method of claim 9, further configuring each of the plurality of striking surfaces to physically impact its associated tongue based in part on a beating surface the practitioner strikes the striking surface.

11. The method of claim 9, further configuring the at least one ear hole is configured to produce a crisp acoustic popping sound when optimally struck with a cupped hand.

* * * * *